US008865000B2

(12) United States Patent
Michailovski et al.

(10) Patent No.: US 8,865,000 B2
(45) Date of Patent: Oct. 21, 2014

(54) UTILIZATION OF THE NATURALLY OCCURRING MAGNETIC CONSTITUENTS OF ORES

(75) Inventors: Alexej Michailovski, Ludwigshafen (DE); Imme Domke, Mannheim (DE)

(73) Assignees: BASF SE, Ludwigshafen (DE); Siemens AG, München (DE)

( * ) Notice: Subject to any disclaimer, the term of this patent is extended or adjusted under 35 U.S.C. 154(b) by 559 days.

(21) Appl. No.: 13/117,799

(22) Filed: May 27, 2011

(65) Prior Publication Data

US 2011/0303772 A1 Dec. 15, 2011

Related U.S. Application Data

(60) Provisional application No. 61/353,670, filed on Jun. 11, 2010.

(51) Int. Cl.
*B03C 1/01* (2006.01)
*B03C 1/30* (2006.01)

(52) U.S. Cl.
CPC ..... *B03C 1/01* (2013.01); *B03C 2201/20* (2013.01); *B03C 1/30* (2013.01)
USPC ..... 210/679; 210/695; 210/714; 209/8; 209/9; 209/39; 209/214

(58) Field of Classification Search
CPC ..... B03C 1/01; B03C 1/015; B03C 1/30; B03C 2201/20
USPC ..... 210/679, 695, 714; 209/8, 9, 39, 214
See application file for complete search history.

(56) References Cited

U.S. PATENT DOCUMENTS

| | | | |
|---|---|---|---|
| 3,672,579 | A | 6/1972 | Lawver |
| 3,926,789 | A | 12/1975 | Shubert |
| 4,289,528 | A | 9/1981 | Kindig et al. |
| 4,657,666 | A | 4/1987 | Snook et al. |
| 4,810,368 | A | 3/1989 | Seider et al. |
| 4,834,898 | A | 5/1989 | Hwang |
| 5,051,199 | A | 9/1991 | Barwise |
| 5,161,694 | A | 11/1992 | Yoon et al. |
| 5,858,060 | A | 1/1999 | Ruer |
| 2003/0224366 | A1 | 12/2003 | Weindel et al. |
| 2010/0300941 | A1 | 12/2010 | Domke et al. |
| 2011/0120919 | A1 | 5/2011 | Domke et al. |
| 2011/0120954 | A1 | 5/2011 | Domke et al. |
| 2011/0127201 | A1 | 6/2011 | Domke et al. |
| 2011/0163278 | A1 | 7/2011 | Domke et al. |
| 2011/0229384 | A1 | 9/2011 | Michailovski et al. |
| 2011/0240527 | A1 | 10/2011 | Domke et al. |
| 2011/0272623 | A1 | 11/2011 | Domke et al. |
| 2011/0303772 | A1 | 12/2011 | Michailovski et al. |
| 2011/0303773 | A1 | 12/2011 | Domke et al. |
| 2011/0309003 | A1 | 12/2011 | Domke et al. |
| 2012/0000857 | A1 | 1/2012 | Domke et al. |
| 2012/0043537 | A1 | 2/2012 | Karpov et al. |
| 2012/0058463 | A1 | 3/2012 | Deuerlein et al. |
| 2012/0125858 | A1 | 5/2012 | Hartmann et al. |
| 2012/0228413 | A1 | 9/2012 | Rieger et al. |
| 2012/0264111 | A1 | 10/2012 | Deuerlein et al. |

FOREIGN PATENT DOCUMENTS

| | | | |
|---|---|---|---|
| EP | 1 200 408 | B1 | 9/2003 |
| GB | 205122 | | 10/1923 |
| WO | WO 84/04701 | | 12/1984 |
| WO | WO 01/37291 | A1 | 5/2001 |
| WO | WO 02/066168 | A1 | 8/2002 |
| WO | WO 03/049530 | A2 | 6/2003 |
| WO | WO 2007/008322 | A1 | 1/2007 |
| WO | WO 2009/030669 | A2 | 3/2009 |
| WO | WO 2009/065802 | A2 | 5/2009 |
| WO | WO 2010/007157 | A1 | 1/2010 |
| WO | WO 2010/026102 | A1 | 3/2010 |
| WO | WO 2010/066770 | A1 | 6/2010 |
| WO | WO 2010/097361 | A1 | 9/2010 |
| WO | WO 2010/100180 | A1 | 9/2010 |
| WO | WO 2010/100181 | A1 | 9/2010 |
| WO | WO 2010/125011 | A2 | 11/2010 |
| WO | WO 2011/012539 | A1 | 2/2011 |
| WO | WO 2011/058039 | A1 | 5/2011 |
| WO | WO 2011/064757 | A1 | 6/2011 |

OTHER PUBLICATIONS

International Preliminary Report on Patentability for PCT/EP2011/059736, Dec. 14, 2012.*

International Search Report issued Sep. 15, 2011, in PCT/EP2011/059736.

S R Gray, et al., "Recovery of Fine Gold Particles by Flocculation with Hydrophobic Magnetite", The Australasian Institute of Mining and Metallurgy, Extractive Metallurgy Conference, Perth, Oct. 2-4, 1991, pp. 223-226.

* cited by examiner

*Primary Examiner* — David A Reifsnyder
(74) *Attorney, Agent, or Firm* — Oblon, Spivak, McClelland, Maier & Neustadt, L.L.P.

(57) ABSTRACT

The present invention relates to a process for separating at least one first material from a mixture comprising this at least one first material, at least one second material and magnetic particles, which comprises the following steps (A) at least partial removal of the magnetic particles by application of a magnetic field gradient, optionally in the presence of at least one dispersing medium, to give a mixture comprising at least one first material and at least one second material and a reduced amount of magnetic particles, (B) contacting of the mixture comprising at least one first material and at least one second material from step (A) with magnetic particles so that the at least one first material and the magnetic particles agglomerate, (C) separation of the agglomeration product from the mixture from step (B) by application of a magnetic field gradient and (D) dissociation of the agglomeration product separated off in step (C) in order to obtain the at least one first material and the magnetic particles separately, and also a control and/or regulation device for a corresponding apparatus.

18 Claims, No Drawings

UTILIZATION OF THE NATURALLY OCCURRING MAGNETIC CONSTITUENTS OF ORES

CROSS REFERENCE TO RELATED APPLICATION

This application claims the benefit of U.S. Provisional Application No. 61/353,670, filed on Jun. 11, 2010.

The present invention relates to a process for separating at least one first material from a mixture comprising this at least one first material, at least one second material and magnetic particles, which comprises the following steps (A) at least partial removal of the magnetic particles by application of a magnetic field gradient, optionally in the presence of at least one dispersing medium, to give a mixture comprising at least one first material and at least one second material and a reduced amount of magnetic particles, (B) contacting of the mixture comprising at least one first material and at least one second material from step (A) with magnetic particles so that the at least one first material and the magnetic particles agglomerate, (C) separation of the agglomeration product from the mixture from step (B) by application of a magnetic field gradient and (D) dissociation of the agglomeration product separated off in step (C) in order to obtain the at least one first material and the magnetic particles separately.

In particular, the present invention relates to a process for enriching ores in the presence of the gangue.

Processes for separating ores from mixtures comprising these are already known from the prior art.

WO 02/0066168 A1 relates to a process for separating ores from mixtures comprising these, in which suspensions or slurries of these mixtures are treated with particles which are magnetic and/or buoyant in aqueous solutions. After addition of the magnetic and/or buoyant particles, a magnetic field is applied so that the agglomerates are separated off from the mixture. However, the degree of binding of the magnetic particles to the ore and the strength of the bond is not sufficient for the process to be able to be carried out with a sufficiently high yield and effectiveness.

U.S. Pat. No. 4,657,666 discloses a process for the enrichment of ores, in which the ore present in the gangue is reacted with magnetic particles, as a result of which agglomerates are formed due to the hydrophobic interactions. The magnetic particles are hydrophobicized on the surface by treatment with hydrophobic compounds, so that binding to the ore occurs. The agglomerates are then separated off from the mixture by means of a magnetic field. The document mentioned also discloses that the ores are treated with a surface-activating solution of 1% of sodium ethylxanthogenate before the magnetic particle is added. Separation of ore and magnetic particles is in this process effected by destruction of the surface-activating substance which has been applied in the form of the surface-activating solution to the ore. Furthermore, only $C_4$-hydrophobicizing agents are used for the ore in this process.

U.S. Pat. No. 4,834,898 discloses a process for separating off nonmagnetic materials by bringing them into contact with magnetic reagents which are enveloped by two layers of surface-active substances. U.S. Pat. No. 4,834,898 further discloses that the surface charge of the nonmagnetic particles which are to be separated off can be influenced by various types and concentrations of electrolyte reagents. For example, the surface charge is altered by addition of multivalent anions, for example tripolyphosphate ions.

S. R. Gray, D. Landberg, N. B. Gray, Extractive Metallurgy Conference, Perth, Oct. 2-4, 1991, pages 223-226, disclose a process for recovering small gold particles by bringing the particles into contact with magnetite. Before contacting, the gold particles are treated with potassium amylxanthogenate. A process for separating the gold particles from at least one hydrophilic material is not disclosed in this document.

WO 2007/008322 A1 discloses a magnetic particle which is hydrophobicized on the surface for removing impurities from mineral substances by magnetic separation processes. According to WO 2007/008322 A1, a dispersant selected from among sodium silicate, sodium polyacrylate and sodium hexametaphosphate can be added to the solution or dispersion.

WO 2009/030669 A2 discloses a process for separating ores from mixtures of these with the gangue by means of magnetic particles, in which the ore is firstly hydrophobicized by means of a suitable substance so that the hydrophobicized ore and the magnetic particles agglomerate and can be separated off. WO 2009/065802 A2 discloses a similar process for separating an ore from the gangue by means of magnetic particles, in which the agglomeration of magnetic particles and ore is based on different surface charges. Both processes are still capable of improvement in terms of their efficiency.

It is an object of the present invention to provide a process by means of which magnetic particles which are present in natural ore mixtures can be effectively separated off so that they do not interfere in the subsequent magnetic isolation of the agglomerates comprising the ore in order to, for example, increase the space-time yield of the process and also of a work-up of the ore following the process. A further object of the present invention is to provide a process by means of which at least one first material, in particular an ore, can be separated efficiently from mixtures comprising at least one first material, at least one second material, in particular the gangue, and magnetic particles. Furthermore, it is an object of the present invention to treat the first material to be separated off in such a way that the agglomeration product between magnetic particles and first material is sufficiently stable to ensure a high yield of first material in the separation.

These objects are achieved according to the invention by a process for separating at least one first material from a mixture comprising this at least one first material, at least one second material and magnetic particles, which comprises the following steps:

(A) at least partial removal of the magnetic particles by application of a magnetic field gradient, optionally in the presence of at least one dispersing medium, to give a mixture comprising at least one first material and at least one second material and a reduced amount of magnetic particles, (B) contacting of the mixture comprising at least one first material and at least one second material from step (A) with magnetic particles so that the at least one first material and the magnetic particles agglomerate, (C) separation of the agglomeration product from the mixture from step (B) by application of a magnetic field gradient and (D) dissociation of the agglomeration product separated off in step (C) in order to obtain the at least one first material and the magnetic particles separately.

In general, all mixtures comprising at least one first material, at least one second material and magnetic particles which are known to those skilled in the art and from which the at least one first material can be separated by means of the process of the invention can be used in the process of the invention.

In a preferred embodiment of the process of the invention, the at least one first material is at least one hydrophobic metal compound or coal and the at least one second material is at least one hydrophilic metal compound.

For the purposes of the present invention, "hydrophobic" means that the corresponding particle is hydrophobic per se or can subsequently be hydrophobicized by treatment with the at least one surface-active substance. It is also possible for a particle which is hydrophobic per se to be additionally hydrophobicized by treatment with the at least one surface-active substance.

"Hydrophobic" means, for the purposes of the present invention, that the surface of a corresponding "hydrophobic substance" or a "hydrophobicized substance" has a contact angle of >90° with water against air. "Hydrophilic" means, for the purposes of the present invention, that the surface of a corresponding "hydrophilic substance" has a contact angle of <90° with water against air.

In a further preferred embodiment of the process of the invention, the at least one hydrophobic metal compound is selected from the group of sulfidic ores, oxidic and/or carbonate-comprising ores, for example azurite [$Cu_3(CO_3)_2(OH)_2$], cuprite [$Cu_2O$] or malachite [$Cu_2[(OH)_2|CO_3]$]), and the noble metals and compounds thereof.

Examples of sulfidic ores which can be used according to the invention are, for example, selected from the group of copper ores consisting of covellite CuS, molybdenum(IV) sulfide, chalcopyrite (copper pyrite) $CuFeS_2$, bornite $Cu_5FeS_4$, chalcocite (copper glance) $Cu_2S$, zinc blend ZnS, galenite PbS, pentlandite $(Ni,Fe)_xS$ where x is about 0.9 and mixtures thereof.

The at least one second material is preferably selected from the group consisting of oxidic and hydroxidic metal compounds, for example silicon dioxide $SiO_2$, silicates, aluminosilicates, for example feldspars, for example albite $Na(Si_3Al)O_8$, mica, for example muscovite $KAI_2[(OH,F)_2AlSi_3O_{10}]$, garnets $(Mg,Ca,Fe^{II})_3(Al, Fe^{III})_2(SiO_4)_3$, $Al_2O_3$, FeO(OH), $FeCO_3$, $Fe_2O_3$, $Fe_3O_4$ and further related minerals and mixtures thereof.

Accordingly, preferably untreated ore mixtures obtained from mine deposits are preferably used in the process of the invention. In a preferred embodiment of the process of the invention, the first materials to be separated off are hydrophobicized on the surface.

Apart from the at least one first material and the at least one second material, magnetic particles are present in the mixture to be treated according to the invention.

According to the invention, all magnetic particles known to those skilled in the art can be present in the mixture to be treated according to the invention.

In a preferred embodiment of the process of the invention, magnetic particles selected from the group consisting of magnetic metals, for example iron, cobalt, nickel and mixtures thereof, ferromagnetic alloys of magnetic metals, magnetic iron oxides, for example magnetite ($Fe_3O_4$), maghemite ($Fe_2O_3$), pyrrhotin ($Fe_{1-x}S$ where $0<x<0.5$), ilmenite ($FeTiO_3$), further minerals of the FeO—$Fe_2O_3$—$TiO_2$ system, cubic ferrites of the general formula (I)

$$M^{2+}_xFe^{2+}_{1-x}Fe^{3+}_2O_4 \quad (I)$$

where

M is selected from among Co, Ni, Mn, Zn and mixtures thereof and $x \leq 1$, hexagonal ferrites, for example barium or strontium ferrite $MFe_{12}O_{19}$ where M=Mg, Ca, Sr, Ba, and mixtures thereof, are present in the mixture to be treated according to the invention.

The average size of the magnetic particles present in the mixture to be treated according to the invention is generally from 100 nm to 100 μm.

In the mixture to be treated according to the invention, the magnetic particles are generally present in an amount of from 0.05 to 10% by weight, preferably from 0.1 to 5% by weight, particularly preferably from 0.2 to 2% by weight, in each case based on the total mixture.

In a preferred embodiment of the process of the invention, the mixture comprising at least one first material, at least one second material and magnetic particles is present in step (A) in the form of particles having an average size of from 100 nm to 100 μm, see, for example, U.S. Pat. No. 5,051,199. In a preferred embodiment, this particle size is obtained by milling. Suitable processes and apparatuses are known to those skilled in the art, for example, wet milling in a ball mill.

In a preferred embodiment of the process of the invention, the mixture comprising at least one first material, at least one second material and magnetic particles is therefore milled to particles having an average size of from 100 nm to 100 μm before or during step (A).

Preferred mixtures have a content of at least one first material, in particular of sulfidic minerals, of at least 0.4% by weight, particularly preferably at least 1% by weight, in each case based on the total mixture.

The at least one second material, in particular oxidic minerals, is preferably present in the mixtures to be treated according to the invention in such an amount that the sum of magnetic particles, at least one first material, at least one second material and optionally further minerals is 100% by weight.

Examples of sulfidic minerals which are present in the mixtures which can be used according to the invention are those mentioned above. In addition, sulfides of metals other than copper can also be present in the mixtures, for example sulfides of iron, lead, zinc or molybdenum, i.e. $FeS/FeS_2$, PbS, ZnS or $MoS_2$. Furthermore, oxidic compounds of metals and semimetals, for example silicates or borates or other salts of metals and semimetals, for example phosphates, sulfates or oxides/hydroxides/carbonates and further salts, for example azurite [$Cu_3(CO_3)_2(OH)_2$], malachite [$Cu_2[(OH)_2(CO_3)]$], barite ($BaSO_4$), monazite ((La—Lu)$PO_4$), can also be present in the ore mixtures to be treated in accordance with the invention. Further examples of the at least one first material which is separated off by means of the process of the invention are noble metals, for example Au, Pt, Pd, Rh etc., preferably in the native state.

A typical ore mixture which can be separated by the process of the invention has the following composition: about 30% by weight of $SiO_2$, about 30% by weight of $Na(Si_3Al)O_8$, 2% by weight of $FeCuS_2$, about 0.01% by weight of $MoS_2$, about 1% by weight of $Fe_3O_4$, balance chromium oxides, iron oxides, titanium oxides and magnesium oxides.

The individual steps of the process of the invention will be described in detail below:

Step (A):

Step (A) of the process of the invention comprises the at least partial removal of the magnetic particles by application of a magnetic field gradient, optionally in the presence of at least one dispersion medium, to give a mixture comprising at least one first material and at least one second material and a reduced amount of magnetic particles.

The removal of the magnetic particles can in general be carried out by all magnetic separation processes known to those skilled in the art.

In one embodiment, step (A) of the process of the invention is carried out without addition of a dispersion medium i.e. in the absence of a dispersion medium.

In a second, preferred embodiment, step (A) of the process of the invention is carried out in dispersion, i.e. in the presence of at least one dispersion medium, i.e. the mixture comprising the at least one first material, the at least one second material and the magnetic particles is present in at least one dispersion medium. If the mixture to be treated is provided as such, step (A) of the process of the invention preferably firstly comprises production of a dispersion. Processes for producing a dispersion are known to those skilled in the art.

Suitable dispersion media are in general all dispersion media in which the mixture to be treated according to the invention is not completely soluble. Suitable dispersion media, are, for example, selected from the group consisting of water, water-soluble organic compounds, for example alcohols having from 1 to 4 carbon atoms, and mixtures thereof. In a particularly preferred embodiment, the dispersion medium is water.

In general, the amount of dispersion medium can be selected so that a dispersion which is readily stirrable and/or conveyable is obtained. In a preferred embodiment, the amount of mixture to be treated based on the total slurry or dispersion is from 10 to 50% by weight, particularly preferably from 25 to 40% by weight.

Suitable apparatuses for magnetic separation, preferably on an industrial scale, are known to those skilled in the art.

Step (A) of the process of the invention can be carried out in all apparatuses which are suitable and known to those skilled in the art, for example in a wet drum separator, a high gradient magnetic separator or related appliances.

Step (A) of the process of the invention can be carried out at any suitable temperature, for example from 10 to 60° C.

In step (A) of the process of the invention, the magnetic particles which are present in the minerals which are preferably to be treated are at least partly separated off to give a mixture comprising at least one first material and at least one second material and a reduced amount of magnetic particles.

According to the invention, the magnetic particles are generally separated off to an extent of at least 50%, preferably at least 60%, particularly preferably at least 70%, very particularly preferably completely, in step (A). Preference is given according to the invention to separate off a very large proportion of the magnetic particles in step (A) of the process of the invention in order to obtain the above-described advantages according to the invention to a very large extent.

After step (A), the magnetic particles which have been separated off can in general be isolated from the remaining dispersion by all methods known to those skilled in the art.

Step (A) of the process of the invention results in firstly a mixture comprising at least one first material and a second material in a dispersion medium and secondly magnetic particles, separately from one another.

The magnetic particles obtained in step (A) of the process of the invention, in particular the ferromagnetic minerals, can, according to the invention, be used as raw material and be passed to work-up processes known to those skilled in the art, for example smelting processes.

In a further preferred embodiment of the process of the invention, the magnetic particles which have been separated off in step (A) of the process of the invention can be used in step (B) of the process of the invention. In this preferred embodiment of the process of the invention, the magnetic particles obtained in step (A) may, if appropriate, be subjected to further steps, for example comminution of the particles to an average size from 100 nm to 20 μm, preferably by wet milling, before use in step (B).

Comminution is carried out wet, preferably in aqueous medium, in a ball mill, e.g. a rotary ball mill or stirred ball mill. Inert bodies having a diameter of from 1 to 50 mm and comprising metal or preferably ceramic materials can serve as milling media.

The magnetic particles which have been separated off in step (A) are preferably hydrophobicized on the surface by means of at least one surface-active substance or, depending on the embodiment of step (B), be appropriately functionalized before use in step (B).

Hydrophobicization is preferably effected by bringing the comminuted magnetic particles which are separated off in step (A) into contact with a suitable hydrophobicizing agent, e.g. long-chain fatty acids, phosphonic acids, phosphoric monoesters or diesters or salts thereof, alternatively by means of monoalkylsilanols or dialkylsilanols, for example generated in-situ by hydrolysis of corresponding alkylalkoxysilanes, monoalkylsiloxanes or dialkylsiloxanes. Hydrophobicization can be carried out in an aqueous or organic, preferably aqueous, medium. In one embodiment, a drying and/or calcination step, for example at a temperature below 200° C., is carried out on the hydrophobicized magnetic particle before reuse in step (B). However, preference is given to a process which omits this drying step.

An advantage of the process of the invention, in particular of step (A) according to the invention, is that magnetic particles which interfere in the overall process are removed from the mixture before the at least one first material is actually separated off. As a result of the removal according to the invention in step (A), the naturally occurring magnetic particles which are inactive in step (B) of the process of the invention are separated off, enabling the space-time yield of the overall process to be increased. In the preferred embodiment in which the magnetic particles which have been separated off in step (A) are reused in step (B) of the process of the invention, the amount of magnetic particles to be introduced can additionally be reduced.

Step (B):

Step (B) of the process of the invention comprises contacting of the mixture comprising at least one first material and at least one second material from step (A) with magnetic particles, so that the at least one first material and the magnetic particles agglomerate.

In step (B) of the process of the invention, it is generally possible to use all magnetic particles which are known to those skilled in the art and satisfy the requirements of the process of the invention, for example dispersibility in the dispersion medium used and ability to form sufficiently stable agglomerates with the at least one first material.

Furthermore, the magnetic particles should have a sufficiently high saturation magnetizability, for example 25-300 emu/g, and low remanence so that the agglomerate can be separated in a sufficient amount from the dispersion in step (C) of the process of the invention.

In a preferred embodiment of the process of the invention, magnetic particles selected from the group consisting of magnetic metals, for example iron, cobalt, nickel and mixtures thereof, ferromagnetic alloys of magnetic metals, magnetic iron oxides, for example magnetite ($Fe_3O_4$), maghemite ($Fe_2O_3$), pyrrhotin ($Fe_{1-x}S$ where $0<x<0.5$), ilmenite ($FeTiO_3$), further minerals of the $FeO—Fe_2O_3—TiO_2$ system, cubic ferrites of the general formula (I)

$$M^{2+}_{x}Fe^{2+}_{1-x}Fe^{3+}_{2}O_4 \quad (I)$$

where

M is selected from among Co, Ni, Mn, Zn and mixtures thereof and $x \leq 1$, hexagonal ferrites, for example barium or strontium ferrite $MFe_{12}O_{19}$ where M=Mg, Ca, Sr, Ba, and mixtures thereof, are used in step (B) of the process of the invention.

Very particular preference is given to using magnetite $Fe_3O_4$ as magnetic particles in step (B).

The size of the magnetic particles used according to the invention is preferably from 10 nm to 1 μm.

In a further preferred embodiment of the process of the invention, the magnetic particles separated off in step (A) are used in step (B). Furthermore, it is possible, in this preferred embodiment, to add further magnetic particles of the same type or a different type to the magnetic particles obtained in step (A) before the latter are used in step (B).

The magnetic particles used in step (B) of the process of the invention can, in a preferred embodiment, be hydrophobicized on the surface by means of at least one surface-active substance, for example by means of at least one hydrophobic compound selected from among compounds of the general formula (II)

$$B—Y \quad (II),$$

where

B is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroalkyl, $C_6$-$C_{30}$-aralkyl and Y is a group by means of which the compound of the general formula (II) binds to the magnetic particles.

In a particularly preferred embodiment, B is a linear or branched $C_6$-$C_{18}$-alkyl, preferably linear $C_8$-$C_{12}$-alkyl, very particularly preferably a linear $C_{12}$-alkyl. Heteroatoms which may be present according to the invention are selected from among N, O, P, S and halogens such as F, Cl, Br and I.

In a further particularly preferred embodiment, Y is selected from the group consisting of $—(X)_n—SiHal_3$, $—(X)_n—SiHHal_2$, $—(X)_n—SiH_2Hal$ where Hal is F, Cl, Br, I, and anionic groups such as $—(X)_n—SiO_3^{3-}$, $—(X)_n—CO_2^-$, $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—CO_2^-$, $—(X)_n—CS_2^-$, $—(X)_n—COS^-$, $—(X)_n—C(S)NHOH$, $—(X)_n—S^-$ where X=O, S, NH, $CH_2$ and n=0, 1 or 2, and, if appropriate, cations selected from the group consisting of hydrogen, $NR_4^+$ where the radicals R are each, independently of one another, hydrogen or $C_1$-$C_8$-alkyl, an alkali metal, an alkaline earth metal or zinc, also $—(X)_n—Si(OZ)_4$ where n=0, 1 or 2 and Z=charge, hydrogen or short-chain alkyl radical.

If n=2 in the formulae mentioned, two identical or different, preferably identical, groups B are bound to a group Y.

Very particularly preferred hydrophobicizing substances of the general formula (II) are alkyltrichlorosilanes (alkyl group having 6-12 carbon atoms), alkyltrimethoxysilanes (alkyl group having 6-12 carbon atoms), monoalkyl and dialkyl esters of phosphoric acid (alkyl group having 6-15 carbon atoms), long-chain saturated and unsaturated fatty acids such as lauric acid, oleic acid, stearic acid or mixtures thereof.

According to the invention, the at least one first material to be separated off and the magnetic particles agglomerate in step (B) of the process of the invention.

The agglomeration in step (B) can in general be effected by all attractive forces known to those skilled in the art between the at least one first material and the magnetic particles. According to the invention, essentially only the at least one first material and the magnetic particles agglomerate in step (B) of the process of the invention, while the at least one second material and the magnetic particles essentially do not agglomerate.

In a preferred embodiment of the process of the invention, the mixture comprising at least one first material and at least one second material is milled to particles having a size of from 100 nm to 100 μm before or during step (B).

In a preferred embodiment of step (B) of the process of the invention, the at least one first material and the magnetic particles agglomerate as a result of hydrophobic interactions, different surface charges and/or compounds present in the mixture which selectively couple the at least one first material and the magnetic particles.

The abovementioned alternatives for agglomeration of the at least one first material and the magnetic particles are explained in detail below.

EMBODIMENT B1

In this particularly preferred embodiment B1 of the process of the invention, step (B) is carried out by firstly bringing the at least one first material comprised in the mixture into contact with a surface-active substance to hydrophobicize the at least one first material, then bringing this mixture into contact with magnetic particles so that the magnetic particles and the at least one first material, which has been hydrophobicized on the surface, agglomerate.

For the purposes of the present invention, a "surface-active substance" is a substance which is able to alter the surface of the particle to be separated off, i.e. of the at least one first material, in the presence of the other particles which are not to be separated off so that attachment of a hydrophobic particle occurs as a result of hydrophobic interactions. Surface-active substances which can be used according to the invention selectively became attached to the at least one first material and thereby make the first material suitably hydrophobic.

For the purposes of the present invention, "selectively becomes attached" means that the distribution coefficient of the surface-active substance between the surface of the at least one first material and the surface of the at least one second material is generally >1, preferably >100, particularly preferably >10 000, i.e. the surface-active substance preferentially becomes attached to the surface of the at least one first material and not to the surface of the at least one second material.

In embodiment B1 of step (B) of the process of the invention, a surface-active substance of the general formula (III)

$$A—Z \quad (III)$$

where

A is selected from among linear or branched $C_3$-$C_{30}$-alkyl, $C_3$-$C_{30}$-heteroalkyl, optionally substituted $C_6$-$C_{30}$-aryl, optionally substituted $C_8$-$C_{30}$-heteroalkyl, $C_8$-$C_{30}$-aralkyl and Z is a group by means of which the compound of the general formula (III) binds to the at least one first material to be separated off, which binds to the at least one first material is preferably used in the process of the invention.

In a particularly preferred embodiment, A is a linear or branched $C_4$-$C_{12}$-alkyl, very particularly preferably a linear $C_4$- or $C_8$-alkyl. Any heteroatoms present according to the invention are selected from among N, O, P, S and halogens such as F, Cl, Br and I.

In a further preferred embodiment, A is preferably a linear or branched, preferably linear, $C_6$-$C_{20}$-alkyl. Furthermore, A is preferably a branched $C_6$-$C_{14}$-alkyl, where the at least one substituent, preferably having from 1 to 6 carbon atoms, is preferably present in the 2 position, for example 2-ethylhexyl and/or 2-propylheptyl.

In a further particularly preferred embodiment, Z is selected from the group consisting of anionic groups $—(X)_n—PO_3^{2-}$, $—(X)_n—PO_2S^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—PO_3^{2-}$, $—(X)_n—CS_2^-$, $—(X)_n—COS^-$, $—(X)_n—C(S)NHOH$, $—(X)_n—S^-$ where X is selected from the group consisting of O, S, NH, $CH_2$ and n=0, 1 or 2, if appropriate with cations selected from the group consisting of hydrogen, $NR_4^+$ where the radicals R are each, independently of one another, hydrogen or $C_1$-$C_8$-alkyl, an alkali metal or an alkaline earth metal. The anions mentioned and the corresponding cations form, according to the invention, uncharged compounds of the general formula (III).

If n=2 in the formulae mentioned, two identical or different, preferably identical, groups A are bound to a group Z.

A particularly preferred embodiment is carried out using compounds selected from the group consisting of xanthates $A-O—CS_2^-$, dialkyldithiophosphates $(A-O)_2—PS_2^-$, dialkyldithiophosphinates $(A)_2-PS_2^-$, dithiocarbamates $A_2N—CS_2^-$, xanthogenic esters A-O—C(═S)—S-A', thionocarbamates A-NH—C(═S)—S-A', carboxythionocarbamates A-O—C(═O)—NH—C(═S)—S-A', where A' is in each case an aryl or short-chain alkyl group or an unsaturated aliphatic radical such as allyl, buten-2-yl, 2-methylpropen-2-yl or is selected from the group mentioned in respect of A and the radicals A are each, independently of one another, a linear or branched, preferably linear, $C_6$-$C_{20}$-alkyl, for example n-octyl, or a branched $C_6$-$C_{14}$-alkyl, where the branch is preferably present in the 2 position, for example 2-ethylhexyl and/or 2-propylheptyl. As counterions, preference is given to cations selected from the group consisting of hydrogen, $NR_4^+$ where the radicals R are each, independently of one another, hydrogen or $C_1$-$C_8$-alkyl, an alkali metal or an alkaline earth metal, in particular sodium or potassium, being present in these compounds.

Very particularly preferred compounds of the general formula (III) are n-octylxanthates, di-n-octyldithiophosphates, 2-ethylhexylxanthates and 2-propylheptylxanthates and 2-ethylhexyldithiophosphates and 2-propylheptyldithiophosphates, for example sodium or potassium n-octylxanthate, sodium or potassium di-n-octyldithiophosphate, or mixtures of these compounds.

In the case of noble metals, for example Au, Pd, Rh etc., particularly preferred surface-active substances are monothiols, dithiols and trithiols or 8-hydroxyquinoline, for example as described in EP 1 200 408 B1.

In the case of metal oxides, for example FeO(OH), $Fe_3O_4$, ZnO etc., carbonates, for example azurite $[Cu(CO_3)_2(OH)_2]$, malachite $[Cu_2[(OH)_2CO_3]]$, particularly preferred surface-active substances are octylphosphonic acid (OPS), $(EtO)_3Si$-A, $(MeO)_3Si$-A, with the abovementioned meanings of A, or long-chain saturated or unsaturated fatty acids such as oleic acid, lauric acid, etc. In a preferred embodiment of the process of the invention, hydroxamates are not used as surface-active substances for modifying metal oxides.

In the case of metal sulfides, for example $Cu_2S$, $MoS_2$, etc., particularly preferred surface-active substances are monothiols, dithiols and trithiols or xanthogenates.

In a further preferred embodiment of the process of the invention, Z is $—(X)_n—CS_2^-$, $—(X)_n—PO_2^-$ or $—(X)_n—S^-$ where X is O and n is 0 or 1, together with a cation selected from among hydrogen, sodium or potassium. Very particularly preferred surface-active substances are 1-octanethiol, potassium n-octylxanthate, potassium butylxanthate, octylphosphonic acid or carboxythionocarbamates A-O—C(═O)—NH—C(═S)—S-A' and oxycarbonylthioureas A-O—C(═O)—NH—C(═S)—NH-A' with the abovementioned meanings of A' and A.

The at least one surface-active substance is generally used in an amount which is sufficient to achieve the desired effect. In a preferred embodiment, the at least one surface-active substance is used in an amount of from 5 to 1000 g per metric ton of mixture to be treated.

Further details of this embodiment are disclosed in WO 2009/030669 A2.

Suitable magnetic particles have been mentioned above. In embodiment B1, particular preference is given to using magnetic particles which have been hydrophobicized on the surface by means of at least one surface-active substance. Particularly preferred surface-active substances are the abovementioned compounds of the general formula (II).

EMBODIMENT B2

In this further embodiment B2 of step (B) of the process of the invention, the mixture to be treated from step (A) is firstly brought into contact with at least one hydrocarbon in an amount of from 0.01 to 0.4% by weight, based on the sum of mixture to be treated and at least one hydrocarbon, and this mixture is then brought into contact with magnetic particles.

Embodiment B2 is particularly advantageous when at least one third material is present in addition to the at least one first material and at least one second material in the mixture. The at least one third material is preferably selected from the group mentioned above for the at least one second material, with the at least one second material and the at least one third material being different.

For the purposes of the present invention, a hydrocarbon is an organic chemical compound which is made up essentially of carbon, hydrogen and optionally oxygen. If oxygen is comprised in addition to carbon and hydrogen in the hydrocarbons which can be used according to the invention, it is, for example, present in the form of ester, carboxyl and/or ether groups. In step (B) according to embodiment B2 of the process of the invention, it is possible to use either an essentially uniform hydrocarbon or a hydrocarbon mixture.

Hydrocarbons or hydrocarbon mixtures which can be used according to the invention generally have a low viscosity under the conditions of the process of the invention, so that they are liquid and mobile under the process conditions according to the invention. Preference is given to using hydrocarbons or hydrocarbon mixtures which have a viscosity of from 0.1 to 100 cP, preferably from 0.5 to 5 cP, in each case at 20° C.

Hydrocarbons or hydrocarbon mixtures which can be used according to the invention generally have a flash point of ≤20° C., preferably ≤40° C. The present invention therefore also provides the process of the invention in which the at least one hydrocarbon has a flash point of ≤20° C., particularly preferably ≤40° C.

In a preferred embodiment of the process of the invention, the at least one hydrocarbon is selected from the group consisting of mineral oils, vegetable oils, biodiesel, BtL (Biomass-to-Liquid) fuels, products of coal liquefaction, products of the GtL process (Gas to Liquid, from natural gas) and mixtures thereof.

Mineral oils are, for example, crude oil derivatives and/or oils produced by distillation from brown coal, hard coal, peat, wood, petroleum and, if appropriate, other mineral raw materials. Mineral oils generally comprise hydrocarbon mixtures of paraffinic, i.e. saturated chain-like, hydrocarbons, naphthenic, i.e. saturated cyclic, hydrocarbons and aromatic hydrocarbons.

A particularly preferred crude oil derivative is diesel or gas oil. In general, diesel has a composition known to those skilled in the art. Diesel is based essentially on mineral oil, i.e. diesel is a fraction in the separation of mineral oil by distillation. The main constituents of diesel are predominantly alkanes, cycloalkanes and aromatic hydrocarbons having from about 9 to 22 carbon atoms per molecule and a boiling range from 170° C. to 390° C.

Further terms used for suitable petroleum derivatives comprise: light gas oil (boiling point 235-300° C., depending on the specification also known as "diesel" "diesel fuel" "DF", "heating oil, light", "HEL"), heavy gas oil (boiling point 300 to 375° C.) and also (in the USA) "No. 2 Fuel".

Vegetable oils are generally fats and oils obtained from oil plants. Vegetable oils comprise, for example, triglycerides. Vegetable oils which are suitable according to the invention are, for example, selected from the group consisting of sunflower oil, rapeseed oil, safflower oil, soybean oil, maize germ oil, peanut oil, olive oil, herring oil, cottonseed oil, palm oil and mixtures thereof.

Biodiesel generally has a composition known to those skilled in the art. Biodiesel comprises essentially methyl esters of saturated $C_{15}$-$C_{18}$-fatty acids and unsaturated $C_{18}$-fatty acids, in particular the methyl ester of rapeseed oil.

Products of coal liquefaction can be obtained, for example, by the Fischer-Tropsch or Sasol process. The BtL and GtL processes are known to those skilled in the art.

In a preferred embodiment of the process of the invention, diesel, kerosene and/or light gas oil are used as hydrocarbon in embodiment B2 of step (B). On a laboratory scale, diesel having the brand names Solvesso® and/or Shellsol® can advantageously be used.

In step (B) according to embodiment B2 of the process of the invention, at least one hydrophobicizing agent can optionally also be added. Suitable hydrophobicizing agents are the abovementioned compounds of the general formula (III).

EMBODIMENT B3

In this further embodiment B3 of step (B) of the process of the invention, the mixture to be treated from step (A) is firstly brought into contact with at least one hydrophobicizing agent, so that an adduct is formed from the at least one hydrophobicizing agent and the at least one first material. This adduct is then brought into contact with magnetic particles which have been functionalized on the surface with at least one polymeric compound which has an LCST (Lower Critical Solution Temperature) at a temperature at which the polymeric compound has hydrophobic character, so that the adduct and the functionalized magnetic particles agglomerate.

In embodiment B3 of step (B) of the process of the invention, preference is given to using at least one hydrophobicizing agent having the general formula (III) shown above. As regards the preferred embodiments, what has been said above likewise applies.

The at least one hydrophobicizing agent is generally used in an amount which is sufficient to achieve the desired effect. In a preferred embodiment, the at least one hydrophobicizing agent is added in an amount of from 0.01 to 5% by weight, based on the at least one first material present in the mixture.

Furthermore, embodiment B3 of step (B) comprises contacting of the adduct of at least one first material and hydrophobicizing agent with magnetic particles which are functionalized on the surface with at least one polymeric compound which has an LCST (Lower Critical Solution Temperature). As magnetic particles, it is possible to use those mentioned above.

In embodiment B3, the magnetic particles are functionalized on the surface with at least one polymeric compound.

The polymeric compounds used according to the invention have an LCST (Lower Critical Solution Temperature). Below this LCST, the polymeric compound has hydrophilic character since the polymer chain has, for example, a hydration shell due to attachment of water molecules. Above the LOST, the polymeric compound has hydrophobic character since the polymer chain is, for example, no longer surrounded by a hydration shell. Depending on the polymeric compound, the converse case, namely that the polymeric compound has hydrophobic character below the LCST and has hydrophilic character above the LCST, is also possible. If such as polymeric compound is heated from below the LCST to a temperature above the LCST, the polymeric compound changes from hydrophilic to hydrophobic, or vice versa, at the LCST. Thus, the polymers which can be used according to the invention have hydrophilic or hydrophobic character depending on the temperature.

The change in the polymeric compound from hydrophobic to hydrophilic or vice versa corresponds to a phase transition which in a closed system generally takes place in a narrow temperature range of, for example, 0.5° C. In an open system, the phase transition can extend over a wider range of, for example, 15° C., for example as a result of a change in concentration of the components present, for example polymers and/or foreign substances, variation of the pH and/or the pressure. The temperature range in which the transition is completed generally becomes wider as the chain length increases. When the molecular properties change from hydrophilic to hydrophobic, some water molecules generally initially remain attached to the polymer and these are gradually released. This process is generally completely reversible, as long as the polymeric compound is not chemically modified, for example by increasing the pH.

The properties described for the polymeric compounds which can be used according to the invention are correspondingly essentially also present in the case of the particles, in particular magnetic particles, modified with these polymeric compounds.

In a preferred embodiment of the process of the invention, the polymeric compound is hydrophobic above the LCST and hydrophilic below the LCST.

According to the invention, all polymeric compounds which have an LCST, i.e. have hydrophilic or hydrophobic character at various temperatures, can be used in embodiment B3. For the purposes of the present invention, the term "polymer" refers to a, preferably organic, compound having a molecular weight of at least 500 g/mol, preferably from 500 to 10 000 g/mol, particularly preferably from 1000 to 7000 g/mol.

In a preferred embodiment of the process of the invention, the at least one polymeric compound is selected from the group consisting of polyvinyl ethers, for example polyvinyl methyl ether, poly-N-alkylacrylamides, for example poly-N—$C_1$-$C_6$-alkylacrylamides, in particular poly-N-isopropylacrylamide, or N-alkylacrylamide-acrylamide copolymers, poly-N-vinylcaprolactams, copolymers based on alkylene oxides, for example copolymers of ethylene oxide, propylene oxide and/or butylene oxide, preferably polymeric compounds which can be obtained by alkoxylation of $C_1$-$C_{12}$-alcohols with from 1 to 130 units of ethylene oxide, propylene oxide and/or butylene oxide, and mixtures thereof. Suitable polymeric compounds and processes for preparing them are described, for example, in Li et al., International Journal of Pharmacology (2006), 2(5), 513-519, and Crespy et al., Polymer International (2007), 56(12), 1461-1468. These polymeric compounds have hydrophilic character below the LCST and hydrophobic character above the LCST.

The abovementioned polymeric compounds which have an LCST are, according to the invention, bound by means of functional groups to the corresponding magnetic particles. These functional groups can be present in the abovementioned polymeric compounds as such or the functional groups can be introduced into the polymeric compounds by methods known to those skilled in the art, i.e. the polymeric compounds are functionalized.

Suitable functional groups are ones which ensure a sufficiently strong bond between magnetic particle and polymeric compound, for example functional groups selected from the group consisting of the thiol group —SH, carboxyl group —$CO_2H$, optionally at least partially esterified phosphonic acid group —$PO_3R'_2$ where R' is hydrogen or $C_1$-$C_6$-alkyl (Va), optionally at least partially esterified phosphoric acid group —O—$PO_3R''_2$ where R" is hydrogen or $C_1$-$C_6$-alkyl (Vb), hydroxamate group (Vc), xanthogenate group (Vd)

(Va)

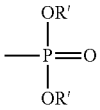

(Vb)

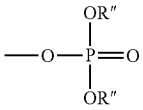

(Vc)

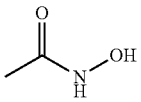

(Vd)

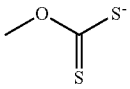

and mixtures thereof, particularly preferably selected from the group consisting of the thiol group —SH, carboxyl group —$CO_2H$, optionally at least partially esterified phosphonic acid group —$PO_3R'_2$ where R' is hydrogen or $C_1$-$C_6$-alkyl (Va), optionally at least partially esterified phosphoric acid group —O—$PO_3R''_2$ where R" is hydrogen or $C_1$-$C_6$-alkyl (Vb), hydroxamate group (Vc). The xanthogenate group (Vd) is preferred for coupling to sulfidic compounds.

In a preferred embodiment, the at least one polymeric compound is at least one functionalized copolymer of ethylene oxide, propylene oxide and/or butylene oxide, particularly preferably a compound of the general formula (VI)

$$F\text{-}[(EO)_x\text{—}(PO)_y\text{—}(BuO)_z]\text{—}B \qquad (VI)$$

where

F is a functional group which selectively binds to the at least one magnetic particle, B is a alkyl radical having from 1 to 6 carbon atoms, EO is ethylene oxide, PO is propylene oxide, BuO is butylene oxide, x is an integer or rational number from 0 to 130, preferably from 0 to 40, y is an integer or rational number from 0 to 130, preferably from 1 to 35, and z is an integer or rational number from 0 to 130, preferably from 0 to 40, where $1 \leq x+y+z \leq 130$, preferably $10 \leq x+y+z \leq 130$.

In the compound of the general formula (VI), F is a functional group which binds selectively to the at least one magnetic particle. The choice of this functional group depends on the at least one magnetic particle to which the functional group is to bind. A dissociation-stable bond should preferably be formed between the at least one magnetic particle and the at least one polymeric compound of the general formula (VI).

In a preferred embodiment, F is selected from the group consisting of the carboxyl group —$CO_2H$, optionally at least partially esterified phosphonic acid group —$PO_3R'_2$ where R' is hydrogen or $C_1$-$C_6$-alkyl (Va), optionally at least partially esterified phosphoric acid group —O—$PO_3R''_2$ where R" is hydrogen or $C_1$-$C_6$-alkyl (Vb), hydroxamate group (Vc), xanthogenate group (Vd)

(Va)

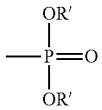

(Vb)

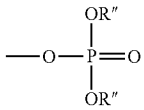

(Vc)

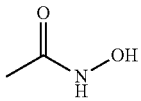

(Vd)

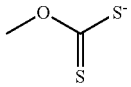

and mixtures thereof, particularly preferably an optionally at least partially esterified phosphonic acid group (Va) or an optionally at least partially esterified phosphoric acid group (Vb).

The functional groups Va to Vd are preferably bound to the polymer via free electron pairs.

In the general formula (VI), B is an alkyl radical having from 1 to 6 carbon atoms, for example methyl, ethyl, propyl, butyl, for example n-butyl, pentyl, hexyl.

The polymeric compounds of the general formula (VI) have an LCST which generally depends in each case on the amount of the individual alkylene oxides, i.e. ethylene oxide, propylene oxide and/or butylene oxide, in the polymer. A polymeric compound which is made up exclusively of propylene oxide has, for example, an LCST of <−10° C. A polymeric compound which is made up exclusively of ethylene oxide has, for example, an LCST of >120° C. An LCST of the polymeric compound which is suitable for the process of the invention can therefore be set by choice of the type and amount of the alkylene oxides.

In a preferred embodiment, the LCST of the polymeric compound used in the process of the invention is from −10 to 100° C., particularly preferably from 5 to 45° C., very particularly preferably from 20 to 40° C. The LCST of a polymeric compound is generally in the temperature range from about 5 to 15° C. The width of this range generally depends on the uniformity, i.e. the monodispersity, of the polymeric compound used. The higher the monodispersity, the narrower the range of the LCST.

Processes for preparing polymeric compounds of the general formula (VI) are known to those skilled in the art.

The functionalization of the magnetic particles with the at least one polymeric compound can be effected by all methods known to those skilled in the art. In a preferred embodiment, the magnetic particles are functionalized with the at least one polymeric compound by firstly producing the magnetic particles themselves by known methods. These magnetic particles are then modified by bringing them into contact with a solution of the functionalized polymeric compound, in particular compounds of the general formula (VI), in water or in an organic solvent, for example low molecular weight alcohols or ketones, and the product obtained is washed with an appropriate solvent to remove excess polymeric compound.

The contacting in embodiment B3 of step (B) is preferably carried out at a temperature at which the polymeric compound used has hydrophobic character so that the switchably functionalized magnetic particles and the hydrophobized at least one first material agglomerate. Depending on the polymeric compound, this temperature can be above or below the LCST; the temperature is preferably above the LCST.

The contacting in embodiment B3 of step (B) is preferably carried out at a temperature which is greater than the LCST of the polymeric compound and less than the boiling point of the suspension medium used, particularly preferably at a temperature which is from 1 to 20° C. above the LCST. The contacting according to embodiment B3 is thus, in a preferred embodiment, carried out at a temperature of from 6 to 65° C., particularly preferably from 21 to 60° C.

If the polymeric compound has hydrophobic character below the LCST, the contacting in embodiment B3 is carried out at a temperature which is above the melting point of the suspension medium used and below the LCST of the polymeric compound. In this case, the contacting in embodiment B3 is preferably carried out at a temperature which is from 1 to 20° C. below the LCST. The contacting in embodiment B3 is in this case preferably carried out at a temperature of from −15 to 44° C., particularly preferably from 0 to 39° C.

EMBODIMENT B4

In this further preferred embodiment B4, step (B) of the process of the invention is carried out by producing a dispersion of the mixture comprising at least one first material and at least one second material and the magnetic particles in a suitable dispersion medium and setting the pH of the resulting dispersion to a value at which the at least one first material and the magnetic particles bear opposite surface charges, so that these agglomerate.

As magnetic particles, it is possible to use all magnetic particles known to those skilled in the art which satisfy the requirements of embodiment B4 of step (B) of the process of the invention, for example dispersibility in the dispersion medium used and the ability to agglomerate with the at least one first material. Furthermore, the magnetic particles should have a defined loading with surface charges at a defined pH. The surface charges can be quantified by the ξ potential. Preference is given to using the abovementioned magnetic particles.

In a particular embodiment of the process of the invention, the dispersion produced in embodiment B4 of step (B) comprises at least one buffer system. Suitable buffer systems for setting a particular pH are known to those skilled in the art and are commercially available. A suitable buffer for a weakly acidic pH range (pH=5.0-6.2) is, for example, the carbonic acid-silicate buffer. A similar pH range (pH=5.2-6.7) can be set by means of 2-(N-morpholino)ethanesulfonic acid. A suitable buffer for a pH in the alkaline range (pH=8.2-10.2) is the ammonia buffer. The addition of a buffer system to the suspension serves to set a suitable pH which is relatively stable.

The dispersion produced in embodiment B4 of step (B) of the process of the invention preferably has a pH of from 2 to 13. The pH of the dispersion produced depends on the isoelectric points of the materials to be separated from one another. The limits of the pH range are also determined by the stability of the magnetic particles used; for example, $Fe_3O_4$ is not stable below pH 2.88.

The pH of the dispersion obtained is, according to the invention, set to a value at which the at least one first material and the magnetic particles bear opposite surface charges, so that they agglomerate.

The agglomeration of the at least one first material and the magnetic particles is based on their different surface charge in aqueous suspension as a function of the pH.

The surface charge of a particle in equilibrium with the surrounding liquid phase is determined by the zeta potential ξ. This varies as a function of the pH of the solution or suspension. At the isoelectric point (IEP), the surface charge of the particle changes its sign, i.e. the zeta potential ξ measured at the isoelectric point is exactly zero. When the zeta potential ξ is plotted on the y axis in a coordinate system against the pH on the x axis, the resulting curve intersects the x axis at the isoelectric point.

Particles having different surface charges agglomerate with one another, while particles having the same charge repel one another.

At least one first material, at least one second material and magnetic particles having the isoelectric points IEP(1), IEP(2) and IEP(M) where IEP(1)≤IEP(M)≤IEP(2), are present in the dispersion produced according to embodiment B4 of step (B). If the relationship IEP(1)≤pH≤IEP(M) applies, i.e. the pH of the suspension is between the isoelectric points of the at least one first material and the magnetic particles, the at least one first material and the magnetic particles have opposite surface charges, while the at least one second material and the magnetic particles have the same surface charge, so that the at least one first material and the magnetic particles agglomerate. Conversely, when the pH is between the isoelectric point of the magnetic particles and that of the at least one second material, i.e. IEP(M)≤pH≤IEP(2), the magnetic particles and the at least one second material agglomerate while the magnetic particles and the at least one first material repel one another because they have the same surface charge.

The isoelectric point of the materials present in the mixture, comprising at least one first material, at least one second material and magnetic particles, can be determined via the ξ potential of the individual materials in aqueous solution. The ξ potential measured varies with the type of instrument used, the measurement method and the evaluation method. Important parameters which have to be indicated are temperature, pH, concentration of the salt background solution, conductivity and measurement voltage, so that the parameters mentioned have to be known for measurements to be comparable.

Further details on this subject and illustrative isoelectric points of various preferred metal oxides and sulfides are disclosed in WO 2009/065802 A2, whose contents are expressly incorporated by reference.

In the preferred embodiment B4 of step (B) of the process of the invention, the pH is therefore preferably set to a value which is between the isoelectric point of the at least one first material and the isoelectric point of the magnetic particles.

The pH can be set by all methods known to those skilled in the art, for example addition of at least one basic compound or at least one acidic compound to the dispersion obtained. Whether a basic compound or an acidic compound has to be added depends on the pH of the dispersion produced. If the pH of this dispersion is below the range between the isoelectric point of the at least one first material and the isoelectric point of the magnetic particles, at least one base is added to increase the pH. If the pH of this dispersion is above the range between the isoelectric point of the at least one first material and the isoelectric point of the magnetic particles, at least one acid is added to lower the pH.

Suitable basic compounds are selected from the group consisting of organic or inorganic bases, for example ammonia, sodium hydroxide NaOH, potassium hydroxide KOH, amines, for example triethylamine, soluble alkaline metal carbonates and mixtures thereof.

Suitable acidic compounds are selected from the group consisting of organic or inorganic acids, for example mineral acids such as hydrochloric acid, nitric acid, sulfuric acid, phosphoric acid, organic acids such as formic acid, acetic acid, propionic acid, methanesulfonic acid and mixtures thereof.

For example, to separate $Cu_2S$ from $SiO_2$, the pH is preferably set to 3. To separate $MoS_2$ from $SiO_2$, the pH is preferably set to >2.

EMBODIMENT B5

In this further preferred embodiment B5 of step (B) of the process of the invention, the magnetic particles together with at least one bifunctional molecule of the general formula (VII)

$$(F^1)_x\text{-}(A)_n\text{-}(F^2)_y \qquad \text{(VII)},$$

where $F^1$ is a functional group which selectively binds to the at least one magnetic particle, $F^2$ is a functional group which selectively binds to the at least one first material, A is a structural unit selected from among a $CRH_2$ group where R is selected from among hydrogen and linear or branched hydrocarbon radicals having from 1 to 30 carbon atoms, an aromatic or heteroaromatic unit, a cyclic or heterocyclic unit, an unsaturated, branched or unbranched hydrocarbon chain having from 2 to 30 carbon atoms, a heteroatom and combinations of the abovementioned structural units, n is an integer from 1 to 100, x is an integer from 1 to 4 and y is an integer from 1 to 4, or an adduct of the two is brought into contact with the mixture comprising the at least one first material and at least one second material, so that an adduct is formed from the magnetic particles, the bifunctional compound of the general formula (VII) and the at least one first material.

$F^1$ and $F^2$ are each functional groups which bind selectively to the magnetic particles ($F^1$) or to the at least one first material ($F^2$).

For the purposes of the present invention, "selectively" means that the respective functional group $F^1$ or $F^2$ binds to an extent of from 50 to 95%, preferably from 70 to 98%, particularly preferably from 80 to 98%, based on $F^1$, to the magnetic particles or, based on $F^2$, to the at least one first material, in each case in the presence of the at least one second material, in each case based on all bonds between functional groups and components present in the mixture.

In a preferred embodiment, $F^1$ is a functional group which selectively binds to the magnetic particles in the presence of silicates and is particularly preferably selected from among the phosphonic acid group —$OP(OH)_2$ and the carboxyl group —COOH.

In a further preferred embodiment, $F^2$ is a functional group which in the presence of oxidic ores, for example those mentioned above, in particular $SiO_2$ or albite, binds to the at least one first material and is particularly preferably selected from the group consisting of the thiol group —SH, hydroxy group —OH, xanthogenate —OCSSH, thiolate —$S^-$, dihydroxy group, for example a 1,2-dihydroxy or 1,3-dihydroxy group, a dithiol group, for example a 1,2-dithiol or 1,3-dithiol group, a thiohydroxy group, for example a 1,2-thiohydroxy or 1,3-thiohydroxy group, functional groups of the general formula (VIII) and mixtures thereof, (VIII)

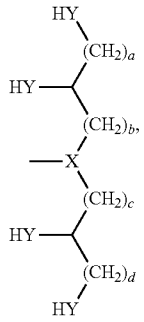

where the radicals Y are each, independently of one another, S, NH, O, preferably, independently of one another, S or O, X is N, P, $CH_2$, preferably N, a, b, c, d are each, independently of one another, an integer from 1 to 6, preferably 1 or 2.

The functional groups $F^2$ of the general formula (VIII) are bound to $-(A)_n-$ via the free bond on X.

Very particularly preferred functional groups $F^2$ of the general formula (VIII) are selected from the group consisting of compounds of the formulae (VIIIa), (VIIIb), (VIIIc), (VIIId) and (VIIIe):

(VIIIa)

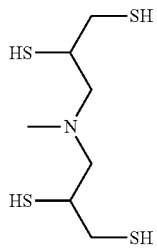

-continued (VIIIb)

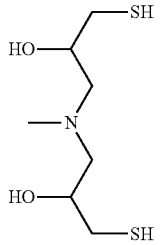

(VIIIc)

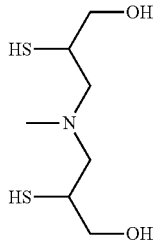

(VIIId)

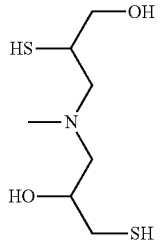

(VIIIe)

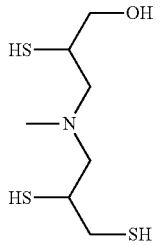

In the general formula (VII), A is a structural unit selected from among a $CRH_2$ group where R is selected from among hydrogen and linear or branched hydrocarbon radicals having from 1 to 30 carbon atoms, an aromatic or heteroaromatic unit, a cyclic or heterocyclic unit, an unsaturated, branched or unbranched hydrocarbon chain having from 2 to 30 carbon atoms, a heteroatom and combinations of the abovementioned structural units, preferably a $CH_2$ group, with it also being possible according to the invention for —C—C double and/or triple bonds to be present in the basic framework of the bifunctional compounds formed by $-(A)_n-$. Heteroatoms are, for example, O, S, N, and/or P. Suitable aromatic or heteroaromatic units are, for example, selected from among substituted or unsubstituted aromatic or heteroaromatic units having from 6 to 20 carbon atoms and optionally heteroatoms, for example phenyl, benzyl and/or naphthyl. The aromatic units can be bound into the chain via the 1,2, 1,3 and/or 1,4 positions.

In the compound of the general formula (VII), x and y indicate the number of functional groups $F^1$ or $F^2$ present in the molecule. Preference is given to x and y each being, independently of one another 1, 2 or 3, particularly preferably 1 or 2, very particularly preferably 1.

A very particularly preferred compound of the general formula (VII) is (2-mercaptophenyl)phosphonic acid

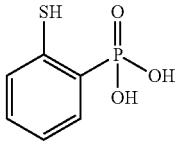

In a preferred embodiment of the process of the invention, the functional group $F^1$ in the compound of the general formula (VII) binds to the at least one magnetic particle and the functional group $F^2$ in the compound of the general formula (VII) binds to the at least one first material.

After step (B) of the process of the invention, in particular after the preferred embodiments B1, B2, B3, B4 or B5 have been carried out, agglomerates of magnetic particles and the at least one first material, the at least one second material and optionally at least one third material are present in the dispersion. This dispersion is, according to the invention, preferably transferred directly to step (D).

Step (C):

Step (C) of the process of the invention comprises separation of the agglomeration product from the mixture of step (B) by application of a magnetic field gradient.

Suitable apparatuses for the magnetic separation in step (C), preferably on an industrial scale, are known to those skilled in the art.

Step (C) of the process of the invention can be carried out in all suitable apparatuses known to those skilled in the art, for example in a wet drum separator, a high-gradient magnetic separator or related appliances.

Step (C) of the process of the invention can be carried out at any suitable temperature, for example from 10 to 60° C.

In step (C), the agglomeration product from step (B) can, if appropriate, be separated off by all methods known to those skilled in the art.

Step (D):

Step (D) of the process of the invention comprises dissociation of the agglomeration product which has been separated off in step (C) in order to obtain the at least one first material and the magnetic particles separately.

The dissociation method employed in step (D) of the process of the invention depends on the method by which the agglomerates have been formed in step (B).

The dissociation can be carried out by methods which are suitable for dissociating the agglomeration product in such a way that the magnetic particles can be recovered in reusable form. In a preferred embodiment, the magnetic particles are, particularly preferably together with magnetic particles separated off in step (A), reused in step (B).

In a preferred embodiment, the dissociation in step (E) of the process of the invention is carried out by treating the agglomeration product with a substance selected from the group consisting of organic solvents, basic compounds, acidic compounds, oxidizing agents, reducing agents, surface-active compounds and mixtures thereof.

Examples of suitable organic solvents are methanol, ethanol, propanol, for example n-propanol or isopropanol, aromatic solvents, for example benzene, toluene, xylenes, ethers, for example diethyl ether, methyl t-butyl ether, ketones, for example acetone, aromatic or aliphatic hydrocarbons, for example saturated hydrocarbons having, for example, from 8 to 16 carbon atoms, for example dodecane and/or Shellsol®, diesel fuels and mixtures thereof. The main constituents of diesel fuel are predominantly alkanes, cycloalkanes and aromatic hydrocarbons having from about 9 to 22 carbon atoms per molecule and a boiling range from 170° C. to 390° C.

Examples of basic compounds which can be used according to the invention are aqueous solutions of basic compounds, for example aqueous solutions of alkali metal and/or alkaline earth metal hydroxides, for example KOH, NaOH, milk of lime, aqueous ammonia solutions, aqueous solutions of organic amines of the general formula $R^2_3N$, where the radicals $R^2$ are selected independently from the group consisting of $C_1$-$C_8$-alkyl, optionally substituted by further functional groups. In a preferred embodiment, step (E) is carried out by adding aqueous NaOH solution to a pH of 13, for example for the isolation of OPA-modified $Cu_2S$. The acidic compounds can be mineral acids, for example HCl, $H_2SO_4$, $HNO_3$ or mixtures thereof, organic acids, for example carboxylic acids. As oxidizing agent, it is possible to use, for example, $H_2O_2$, for example as a 30% strength by weight aqueous solution (Perhydrol). For the isolation of $Cu_2S$ modified with thiols, preference is given to using $H_2O_2$ or $Na_2S_2O_4$.

Examples of surface-active compounds which can be used according to the invention are nonionic, anionic, cationic and/or zwitterionic surfactants.

In a preferred embodiment, the agglomeration product composed of hydrophobic material and magnetic particles is dissociated by means of an organic solvent, particularly preferably by means of acetone and/or diesel. This operation can also be assisted mechanically. In a preferred embodiment, ultrasound is used to assist the dissociation process.

In general, the organic solvent is used in an amount which is sufficient to dissociate virtually all of the agglomeration product. In a preferred embodiment, from 20 to 100 ml of the organic solvent are used per gram of agglomeration product of hydrophobic material and magnetic particles to be dissociated.

In the case of embodiment B3 of step (B) of the process of the invention, in which agglomerate formation is effected by means of polymeric compounds which have an LCST (Lower Critical Solution Temperature), the separation of the agglomerates in step (E) can be carried out by setting a temperature at which the polymeric compounds do not have hydrophobic character, so that the agglomerates are dissociated.

In the case of embodiment B4 of step (B) of the process of the invention, in which agglomerate formation is effected by setting the pH of the dispersion obtained to a value at which the at least one first material and the magnetic particles bear opposite surface charges, the separation of the agglomerates can be carried out by setting a pH at which the at least one first material and the magnetic particles bear the same surface charges, so that the agglomerates are dissociated.

According to the invention, after the dissociation as per step (D), the at least one first material and the magnetic particles are present as dispersion either in the abovementioned dissociation reagent, preferably an organic solvent, and/or in water.

In a preferred embodiment, the process of the invention additionally has the following step (E):

(E) separation of the magnetic particles from the mixture from step (D) in order to obtain the at least one first material.

The magnetic particles in the dispersion comprising these magnetic particles and the at least one first material can be separated off from the solution by means of a permanent magnet or electromagnet. In a preferred embodiment, the separation in the optional step (E) is carried out in a manner analogous to step (C) of the process of the invention. Individual process parameters, for example solids content, flow rate, can be modified as required in step (E).

After removal of the magnetic particles, the desired at least one first material is present in a dispersion comprising, if appropriate, a dissociation reagent and/or water.

The first material to be separated off, preferably the metal compound to be separated off, is preferably separated from the dissociation reagent, for example an organic solvent, by for example, distillation.

The first material which can be obtained in this way can be purified by further processes known to those skilled in the art. The solvent can, if appropriate after purification, be recirculated to the process of the invention. If a dispersion of the at least one first material in water is present after removal of the magnetic particles, the water can likewise be removed by methods known to those skilled in the art, for example distillation, filtration, decantation and/or centrifugation.

In the steps (A), (B), (C), (D) and/or optionally (E), further dispersion medium may, if appropriate, be added to the dispersion present. According to the invention, it is possible to add further dispersion medium in order to obtain dispersions having a lower solids content in the individual steps.

Dispersion media suitable as dispersion media to be additionally added are all dispersion media which have already been mentioned in respect of step (A), in particular water.

The optional addition of dispersion medium can, according to the invention, be effected by all methods known to those skilled in the art.

The present invention also provides a control and/or regulation device for an apparatus for separating at least one first material from a mixture comprising this at least one first material, at least one second material and magnetic particles, having a machine-readable program code which has control commands which cause the control and/or regulation device to carry out the process of the invention.

The invention claimed is:

1. A process, comprising:

separating a first material from a mixture comprising the first material, a second material, and magnetic particles, wherein the separating comprises:

(A) at least partially removing the magnetic particles by application of a magnetic field gradient thereby obtaining a mixture comprising the first material and the second material, and a reduced amount of magnetic particles, (B) contacting the mixture comprising the first material and the second material from (A) with magnetic particles so that the first material and the magnetic particles agglomerate to form an agglomeration product, (C) separating the agglomeration product from the mixture from (B) by application of a magnetic field gradient, and (D) dissociating the agglomeration product separated off in (C), thereby obtaining the first material and the magnetic particles separately.

2. The process according to claim 1, wherein the first material is a hydrophobic metal compound or coal and the second material is a hydrophilic metal compound.

3. The process according to claim 2, wherein the hydrophobic metal compound is at least one selected from the group consisting of sulfidic minerals, oxidic-comprising minerals, carbonate-comprising minerals, and oxidic- and -carbonate-comprising minerals.

4. The process according to claim 2, wherein the hydrophilic metal compound is at least one selected from the group consisting of oxidic metal compounds and hydroxidic metal compounds.

5. The process according to claim 1, wherein the magnetic particles in (B) are selected from the group consisting of magnetic metals, ferromagnetic alloys of magnetic metals, magnetic iron oxides further ferromagnetic minerals of a $FeO—Fe_2O_3—TiO_2$ system, hexagonal ferrites, and cubic ferrites of formula (I):

$$M^{2+}_xFe^{2+}_{1-x}Fe^{3+}_2O_4 \quad (1)$$

wherein M is Co, Ni, Mn, Zn, or any mixture thereof, and $x \leq 1$.

6. The process according to claim 5, wherein the magnetic metals are selected from the group consisting of iron, cobalt, nickel and mixtures thereof.

7. The process according to claim 5, wherein the magnetic iron oxides are selected from the group consisting of magnetite, maghemite, pyrrhotin, and ilmenite.

8. The process according to claim 5, wherein the magnetic particles in (B) comprise at least one hexagonal ferrite selected from the group consisting of barium ferrite, and strontium ferrite, and $MFe_{12}O_{19}$ wherein M is Mg, Ca, Sr, Ba, and any mixture thereof.

9. The process according to claim 1, wherein the magnetic particles in (B) have been hydrophobicized on a surface thereof by a surface-active substance.

10. The process according to claim 1, wherein the magnetic particles separated off in (A) are the magnetic particles in (B).

11. The process according to claim 1, further comprising:

(E) separating the magnetic particles from the mixture from (D) thereby obtaining the first material.

12. The process according to claim 1, wherein the first material and the magnetic particles agglomerate in (B) as a result of hydrophobic interactions, different surface charges, compounds present in the mixture which selectively couple the first material and the magnetic particles, or any combination thereof.

13. The process according to claim 1, further comprising:

milling the mixture comprising the first material and the second material to particles having an average size of from 100 nm to 100 μm before or during (B).

14. The process according to claim 1, wherein the partially removing in (A) occurs in the presence of at least one dispersing medium.

15. The process according to claim 14, wherein the dispersion medium is water.

16. The process according to claim 1, wherein, during said (B) contacting, a bifunctional molecule represented by formula (VIII):

$$(F^1)_x\text{-}(A)_n\text{-}(F^2)_y \quad (VIII)$$

contacts said first and second material from (A) along with said magnetic particles, so that the first material and the magnetic particles agglomerate to form an agglomeration product, and wherein $F^1$ is a functional group which selectively binds to the at least one magnetic particle, $F^2$ is a functional group which selectively binds to the at least one first material, A is a structural unit selected from among a $CRH_2$ group where R is selected from among hydrogen and linear or branched hydrocarbon radicals having from 1 to 30 carbon atoms, an aromatic or heteroaromatic unit, a cyclic or heterocyclic unit, an unsaturated, branched or unbranched hydrocarbon chain having from 2 to 30 carbon atoms, a heteroatom and combinations of the above-mentioned structural units, n is an integer from 1 to 100, x is an integer from 1 to 4 and y is an integer from 1 to 4.

17. The process according to claim 16, wherein said bifunctional molecule represented by formula (VIII) is at least one of:

(VIIIa)

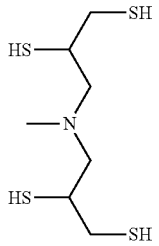

(VIIIb)

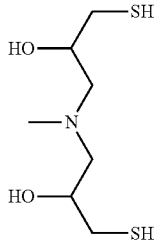

(VIIIc)

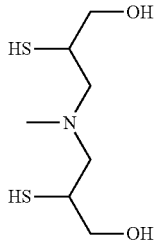

(VIIId)

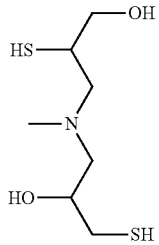

(VIIIe)

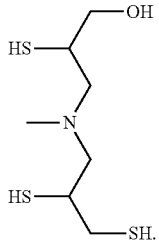

18. The process according to claim 16, wherein said bifunctional molecule represented by formula (VIII) is
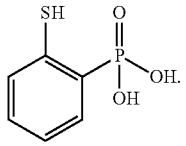
* * * * *